US007152411B2

(12) United States Patent
McCaffrey et al.

(10) Patent No.: US 7,152,411 B2
(45) Date of Patent: Dec. 26, 2006

(54) RABBET MOUNTED COMBUSTER

(75) Inventors: Timothy Patrick McCaffrey, Swampscott, MA (US); Barry Francis Barnes, Milford, CT (US); Stephen John Howell, West Newbury, MA (US); John Carl Jacobson, Melrose, MA (US)

(73) Assignee: General Electric Company, Schenectady, NY (US)

( * ) Notice: Subject to any disclaimer, the term of this patent is extended or adjusted under 35 U.S.C. 154(b) by 683 days.

(21) Appl. No.: 10/608,609

(22) Filed: Jun. 27, 2003

(65) Prior Publication Data

US 2004/0261419 A1 Dec. 30, 2004

(51) Int. Cl.
*F02C 7/20* (2006.01)

(52) U.S. Cl. ..... 60/796; 60/800

(58) Field of Classification Search ..... 60/752–760, 60/796, 800

See application file for complete search history.

(56) References Cited

U.S. PATENT DOCUMENTS

| | | | | |
|---|---|---|---|---|
| 2,548,886 | A | 4/1951 | Howard | |
| 4,785,623 | A | 11/1988 | Reynolds | |
| 4,912,922 | A * | 4/1990 | Maclin | 60/796 |
| 5,524,430 | A | 6/1996 | Mazeaud et al. | |
| 5,701,733 | A | 12/1997 | Lewis et al. | |
| 6,401,447 | B1 | 6/2002 | Rice et al. | |
| 6,895,757 | B1 * | 5/2005 | Mitchell et al. | 60/772 |
| 6,904,757 | B1 * | 6/2005 | Mitchell et al. | 60/800 |
| 6,920,762 | B1 * | 7/2005 | Wells et al. | 60/799 |
| 7,036,316 | B1 * | 5/2006 | Howell et al. | 60/772 |
| 2002/0108378 | A1 | 8/2002 | Ariyoshi et al. | |
| 2002/0184891 | A1 | 12/2002 | Conete et al. | |
| 2004/0134199 | A1 * | 7/2004 | Manteiga et al. | 60/796 |
| 2004/0250548 | A1 * | 12/2004 | Howell et al. | 60/796 |
| 2005/0000226 | A1 * | 1/2005 | McCaffrey et al. | 60/796 |
| 2005/0000227 | A1 * | 1/2005 | McCaffrey et al. | 60/796 |
| 2006/0042253 | A1 * | 3/2006 | Fortuna et al. | 60/740 |

OTHER PUBLICATIONS

Brockett, "LV100 AIPS Technology—For Future Army Propulsion," ASME 92-GT-391, Jun. 1992, pp. 1-9.

GE Aircraft Engines, "J85" combuster, in U.S. production and use prior to Jun. 2002, single figure.

GE Aircraft Engin s, "T700" combuster, in U.S. production and use prior to Jun. 2002, single figure.

* cited by examiner

*Primary Examiner*—William H. Rodriquez
(74) *Attorney, Agent, or Firm*—David L. Narciso; Francis L. Conte

(57) ABSTRACT

A combustor includes an outer wall and an inner liner joined to an inner shell in turn mounted to an inner casing. The casing includes a first rabbet at an end flange in which is mounted a corresponding flange of the inner shell. The inner shell also includes a second rabbet which receives an end flange of the inner liner. The inner shell is trapped in the first rabbet by an inner retainer. And, the inner liner is trapped in the surrounding second rabbet for aft-mounting the liner and shell to the inner casing.

20 Claims, 3 Drawing Sheets

RABBET MOUNTED COMBUSTER

The U.S. Government may have certain rights in this invention in accordance with Contract No. DAAE07-00-C-N086 awarded by the Department of the Army.

BACKGROUND OF THE INVENTION

The present invention relates generally to gas turbine engines, and, more specifically, to combustors therein.

A typical gas turbine engine includes a multistage compressor for pressurizing air which is mixed with fuel in a combustor for generating hot combustion gases. The gases flow through a high pressure turbine (HPT) which extracts energy for powering the compressor. A low pressure turbine (LPT) extracts additional energy for providing output work, such as powering a fan in a turbofan aircraft engine application, or providing output shaft power in land-based or marine applications.

In designing a turbine engine for powering a military vehicle, such as a main battle tank, the size and weight of the engine must be as small as possible, which correspondingly increases the difficulty of integrating the various engine components for maximizing performance, efficiency, and life. For example, one engine being developed includes an exhaust heat exchanger or recuperator which uses the hot combustion gases discharged from the turbines for additionally heating the pressurized air discharged from the compressor for increasing engine efficiency. However, this hot pressurized air must also be used for cooling the combustor components themselves which further increases the complexity of the combustor design.

In the last two decades, a double-wall combustor design underwent considerable development effort which did not lead to commercial production thereof. Radially outer and inner combustion liners were supported from corresponding radially outer and inner annular supports. Compressor discharge air was channeled through apertures in the supports for impingement cooling the outer surfaces of the liners. The spent impingement air was then channeled through film cooling and dilution holes in the liners for cooling the liners themselves, as well as providing dilution air for the combustion gases generated in the annular combustion chamber.

A consequence of the double wall combustor design is the inherent difference in operating temperature between the liners and the surrounding supports. Differential operating temperatures result in differential thermal expansion and contraction of the combustor components. Such differential thermal movement occurs both axially and radially, as well as during steady state or static operation and during transient operation of the engine as power is increased and decreased.

The liners must therefore be suitably mounted to their supports for accommodating differential thermal movement therebetween, while also minimizing undesirable leakage of the pressurized air coolant. The liners must be mounted concentrically with each other and with the supports to minimize undesirable variations in temperature distribution, both radially and circumferentially around the outlet end of the combustor as represented by the conventionally known pattern and profile factors.

Liner alignment or concentricity with the turbine is therefore an important design objective for an annular combustor, and is rendered particularly more difficult due to the double-wall liner configuration. Liner alignment affects all aspects of the combustor performance including cooling thereof, dilution of the combustion gases, and turbine performance. And, liner mounting to the supports must minimize thermally induced stress therein for ensuring maximum life of the combustor during operation.

The development combustor disclosed above was designed for proof-of-concept and lacked production features for the intended service life requirements in the tank application. For example, studs were welded to the outer liner and simply bolted to the outer support for mounting the outer liner thereto. In turn, the entire combustor was aft-mounted to a support casing through the outer combustor wall. This bolted design inherently fails to accommodate differential thermal movement between the liner and outer support and results in considerable thermal stresses during operation.

Accordingly, it is desired to provide an improved double-wall combustor design for accommodating differential thermal movement during operation while maintaining concentricity of liner support.

BRIEF DESCRIPTION OF THE INVENTION

A combustor includes an outer wall and an inner liner joined to an inner shell in turn mounted to an inner casing. The casing includes a first rabbet at an end flange in which is mounted a corresponding flange of the inner shell. The inner shell also includes a second rabbet which receives an end flange of the inner liner. The inner shell is trapped in the first rabbet by an inner retainer. And, the inner liner is trapped in the surrounding second rabbet for aft-mounting the liner and shell to the inner casing.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
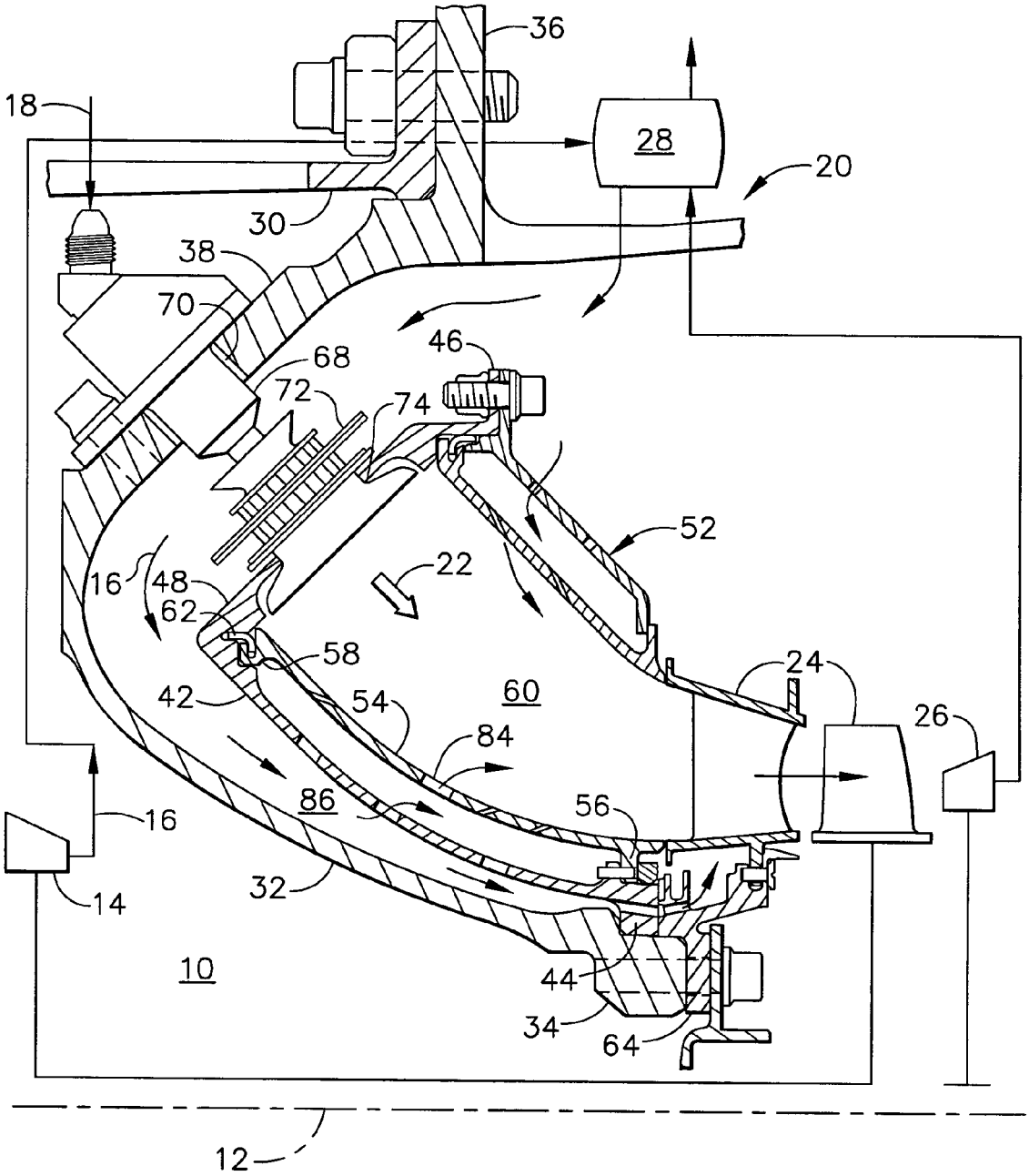
FIG. 1 is a partly sectional, schematic view of a gas turbine engine having one embodiment of a double-wall combustor for powering a land-based vehicle.

Illustrated schematically in FIG. 1 is a gas turbine engine 10 configured for powering a land-based vehicle, for example. The engine is axisymmetrical about a longitudinal or axial centerline axis 12, and includes multistage compressor 14 for pressurizing air 16 during operation. The pressurized air is discharged from the compressor and mixed with fuel 18 in an annular combustor 20 for generating hot combustion gases 22.

The combustion gases are discharged from the combustor into a high pressure turbine (HPT) 24 which extracts energy therefrom for powering the compressor. The high pressure turbine is conventional and includes an annular stator nozzle at the discharge end of the combustor which directs the combustion gases through a row of high pressure turbine rotor blades extending outwardly from a supporting rotor disk joined by a shaft to the compressor rotor.

A low pressure turbine (LPT) 26 follows the HPT and conventionally includes one or more stator nozzles and rotor blade rows for extracting additional energy for powering an output driveshaft, which in turn drives a transmission in the exemplary military tank application.

An exhaust heat exchanger or recuperator 28 receives the combustion gases from the LPT for in turn further heating the compressor discharge air suitably channeled thereto. The so-heated compressor discharge air is then channeled to the combustor for undergoing the combustion process, as well as providing cooling of the combustor components.

The annular combustor illustrated in FIG. 1 is axisymmetrical about the engine centerline axis 12 and is structurally supported from an annular outer casing 30. The combustor is an assembly of components further including an annular radially inner casing, or combustor case, 32 including a first or aft flange 34 and a second or forward flange 36 at opposite ends thereof, and annular header 38 disposed therebetween closely adjoining the casing forward flange 36.

Figure 2:
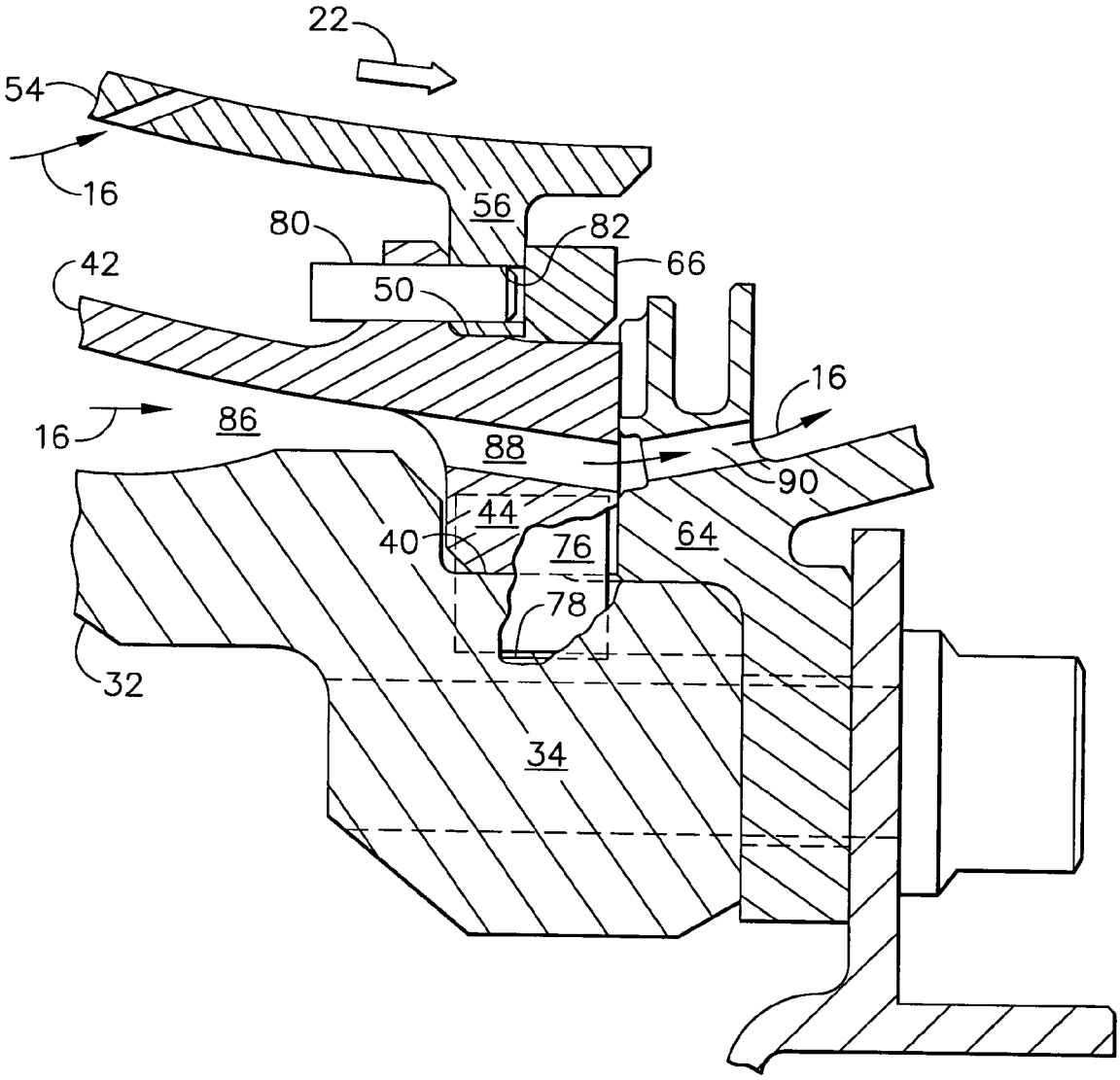
FIG. 2 is an enlarged axial sectional view of the aft end of the combustor inner wall illustrated in FIG. 1.
Figure 3:
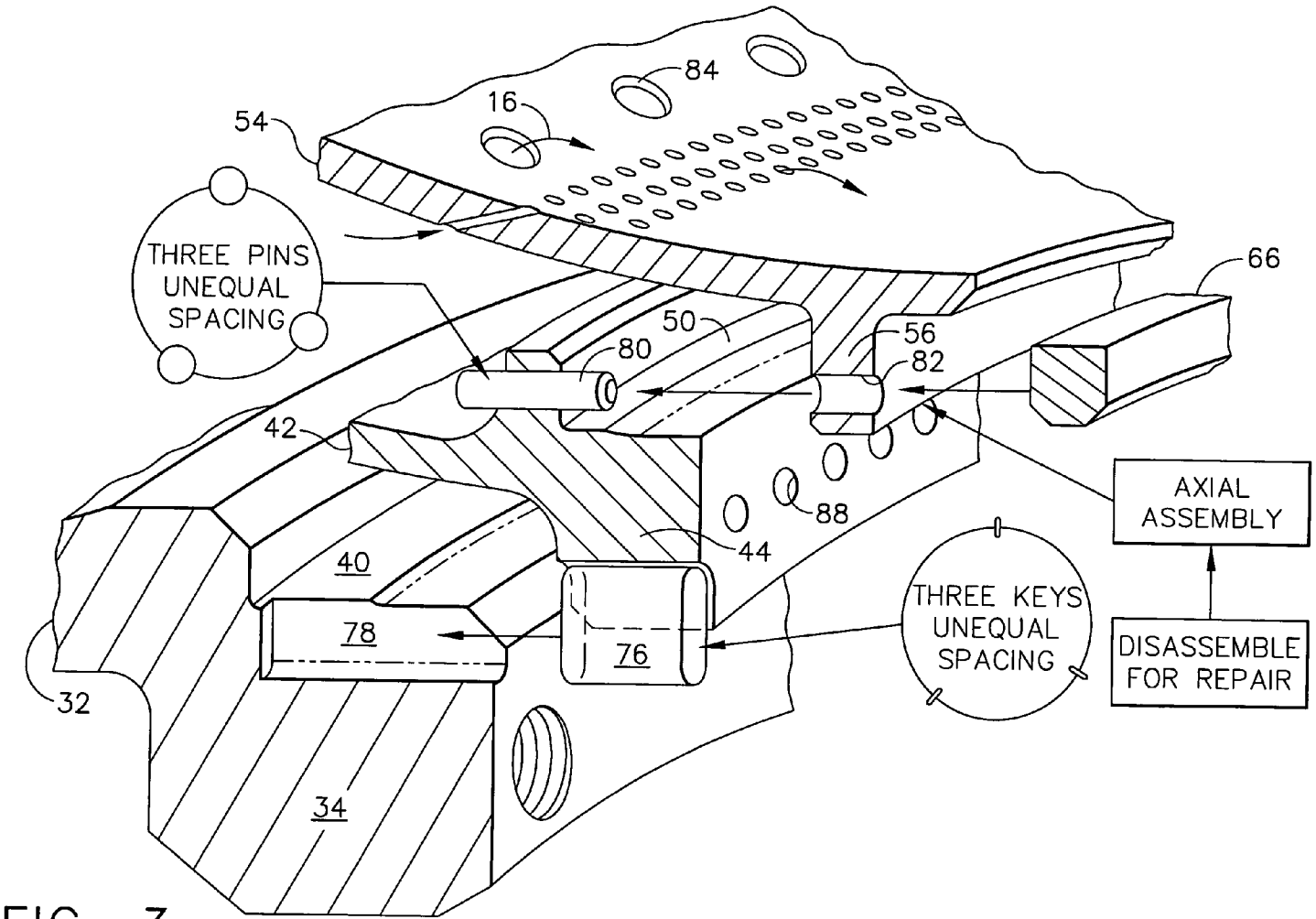
FIG. 3 is an exploded view of the combustor aft inner mount illustrated in FIG. 2 showing schematically the assembly thereof, and disassembly for repair.

As shown in more detail in FIGS. 2 and 3, the inner casing 32 also includes an annular first rabbet 40 extending circumferentially around the casing aft flange 34 facing axially aft and radially outwardly.

Referring again to FIG. 1, the combustor further includes an annular, radially inner shell or support 42 disposed concentrically around the inner casing 32 and supported thereon. The inner shell includes a first or aft flange 44 and a second or forward flange 46 at opposite ends thereof, and an annular dome 48 therebetween closely adjoining the shell forward flange 46. Again shown in more detail in FIGS. 2 and 3, the inner shell also includes an annular radially outer second rabbet 50 around the shell aft flange 44, with the shell aft flange itself being seated in the first rabbet 40.

The combustor illustrated in FIG. 1 also includes an annular outer combustor wall 52 suitably mounted to the shell forward flange 46 by a plurality of fasteners such as bolts. The outer wall 52 is an assembly of an outer shell and an outer combustion liner having suitable apertures therethrough for channeling the pressurized air 16 as a coolant therethrough during operation.

An annular, radially inner combustion liner 54 includes a first or aft flange 56 and a second or forward flange 58 at opposite ends thereof which mount the inner liner to the inner shell in another double-wall configuration spaced radially inwardly from the outer wall 52 to define therebetween an annular combustion chamber 60.

The forward flange 58 of the inner liner includes a radially outwardly facing slot that receives an L-shaped split retainer ring 62 which also seats in an axial groove at the junction of the inner shell and its dome for free-floating the inner liner to the inner shell to permit unrestrained differential thermal expansion and contraction relative to the aft end of the inner liner and shell. The liner aft flange 56, as best illustrated in FIG. 2, is in the form of a radially inwardly extending rim which is seated in the second rabbet 50 of the inner shell. In turn, the shell aft flange 44 is also in the form of a radially inwardly extending rim which is seated in the first rabbet 40.

Accordingly, both the outer and inner double-walls and dome 48 defining the combustion chamber 60 are commonly supported from the combustor case or inner shell 42, which in turn is supported on the aft flange 34 of the inner casing 32 for providing aft-mounting of the combustor, with a corresponding loadpath to the supporting outer casing 30. The forward flange 36 of the inner casing is suitably mounted to a corresponding flange of the outer casing using a row of fasteners such as bolts.

As shown in FIG. 2, the shell aft flange 44 is simply seated in the first rabbet 40 with a suitably close tolerance therebetween, and similarly, the liner aft flange 56 is simply seated in the second rabbet 50 with a suitably close tolerance therebetween. An annular inner retainer 64 is fixedly joined to the casing aft flange 34 by bolt fasteners for example to axially trap the shell aft flange 44 around the first rabbet 40.

Similarly, an annular outer retainer 66 is fixedly joined to the second rabbet 50 to axially trap the liner aft flange 56 around the second rabbet. The outer retainer 66 may be a full ring with a single split, or may be a ring segmented in multiple sections from three to about eight. The individual retainer segments may be suitably tack welded to the second rabbet 50 on the aft side of the liner aft flange 56 opposite to the forward radial shoulder of the second rabbet. Similarly, the inner retainer 64 is preferably a full ring disposed on the aft side of the shell aft flange 44 opposite to the radial shoulder of the first rabbet 40 on the forward side of the shell aft flange.

In this way, the inner liner 54 illustrated in FIG. 1 is concentrically mounted around its supporting shell 42 which in turn is concentrically mounted around its supporting casing 32 which in turn is suspended by the outer casing 30. The inner liner 54 and its supporting inner shell 42 are both mounted at their aft ends to the casing aft flange 34 for permitting differential thermal expansion and contraction relative thereto during operation.

In operation, combustion gases 22 are generated in the combustion chamber 60 and effect a decreasing temperature gradient from the liners to their supporting shells and in turn to the supporting inner casing 32. These components are annular or conical elements subject to both radial expansion and contraction as well as axial expansion and contraction. The inner liner 54 and the inner shell 42 are free to expand and contract relative to their supported aft ends and thereby experience relatively low thermal stress due to differential thermal movement therebetween. And, the aft mounting of the inner liner and its supporting shell ensures concentricity thereof relative to the engine centerline axis 12, and with the HP nozzle.

As illustrated in FIG. 1, the inner retainer 64 forms a portion of the support for the turbine nozzle of the HPT 24. Accordingly, the inner combustion liner 54 and the turbine nozzle are commonly supported from the casing aft flange 34, and concentricity therebetween may be maintained for ensuring accurate radial alignment of the combustion gases 22 as they flow between the stator vanes of the turbine nozzle during operation.

The various components of the combustor should be suitably mounted for maintaining the various alignments required therebetween for enhanced performance of the combustor during operation. The concentricity of both outer and inner combustion liners with the HP turbine nozzle is a significant design objective.

Additional alignment is also required in the combustor. In particular, the casing header 38 includes a row of fuel injectors 68 suitably mounted through corresponding apertures 70 therein. Correspondingly, the dome 48 includes a row of air swirlers 72 suitably mounted in corresponding apertures 74 in the dome.

The fuel injectors and air swirlers may have any conventional configuration, with the fuel injectors being configured for injecting fuel through the center of the corresponding swirler, which typically includes two rows of counterrotating radial vanes which swirl the pressurized compressor air in two counterrotating streams around the injected fuel for atomization thereof for efficient combustion in the combustion chamber.

Since the fuel injectors 70 are mounted in the casing header 38 and the air swirlers 72 are mounted in the casing dome 48, suitable alignment therebetween is required for proper assembly and performance of the combustor.

More specifically, a plurality of tabs or keys 76 as shown in FIGS. 2 and 3 are mounted in respective grooves or slots 78 between the shell aft flange 44 and the first rabbet 40 for maintaining circumferential alignment between the apertures 70,74 in the header 38 and dome 48 for corresponding alignment of the fuel injectors in their respective air swirlers.

In a preferred embodiment, the keys 76 are fixedly mounted, by brazing for example, in the corresponding mounting grooves formed in the radially inner surface of the shell aft flange 44. And, the complementary alignment slots 78 are disposed in the first rabbet 40 and face radially outwardly in radial alignment with the corresponding keys 76. Although the keys 76 could be integrally formed with the shell aft flange 44, it is more practical and economical to separately manufacture the keys and fixedly mount them in the flange.

Three keys 76 are used in the preferred embodiment and have an unequal circumferential spacing varying slightly from 120 degrees apart to ensure that the inner shell 42 may be assembled on the inner casing 32 in a single orientation, which in turn ensures proper alignment of the fuel injectors and air swirlers in their corresponding apertures. The three keys extend radially outwardly from the engine centerline axis and permit unrestrained differential thermal expansion and contraction in the radial direction.

The keys may be suitably small for preventing relative rotation between the inner shell and its supporting inner casing, yet may be sized sufficiently large for accommodating external loads expected in the vehicle mounting of the gas turbine engine. A vehicle-mounted engine is subject to various shock loads as the vehicle travels over rough terrain, especially in a high speed military application. Accordingly, each key 76 is preferably designed for withstanding the maximum expected external loads due to vehicle movement without failing. The multiple keys therefore provide failsafe redundancy in load support, as well as suitably clocking or indexing the circumferential alignment between the inner shell 42 and the inner casing 32.

As shown in FIGS. 2 and 3, the combustor preferably also includes a plurality of axial pins 80 mounted in respective cylindrical sockets 82 between the liner aft flange 56 and the second rabbet 50 for maintaining circumferential alignment between conventional dilution holes 84 provided in the inner liner. Both outer and inner combustion liners include patterns of inclined film cooling holes for channeling a portion of the compressed air 16 for cooling thereof in a conventional manner. And, both liners also include relatively large dilution holes, such as the row of dilution holes 84 illustrated in the inner liner of FIGS. 1 and 3.

The dilution holes are circumferentially aligned with the corresponding fuel injectors and swirlers for minimizing hot streaks from the combustion gases discharged therefrom during operation. Alignment of the dilution holes with the corresponding swirlers is therefore required for proper performance of the combustor, and such alignment is effected by the complementary mating pins 80 in their alignment sockets 82.

As shown in FIGS. 2 and 3, the pins 80 are preferably fixedly joined, by welding for example, to the inner shell 42 to extend radially outwardly over the second rabbet 50 from the forward shoulder thereof. Correspondingly, the sockets 82 are cylindrical apertures disposed axially through the liner aft flange 56 in axial alignment with the corresponding pins.

In the preferred embodiment, three pins are disposed with unequal circumferential spacing varying slightly from 120 degrees apart around the circumference of the forward shoulder of the second rabbet 50. In this way, the dilution holes 84 provided in the inner liner 54 may be maintained in circumferential alignment with the corresponding air swirlers. The unequally spaced pins 80 ensure one and only one proper assembly position of the inner liner on its supporting inner casing.

Since the expected loads between the inner liner and its supporting casing are relatively low, the simple pins 80 may be used instead of the stronger keys 76 at this location. Accordingly, the pins 80 may have any suitable configuration for their location at the second rabbet 50 and for the expected loads thereat. Similarly, the keys 76 may have any suitable configuration for the expected loads at the first rabbet 40.

As initially illustrated in FIG. 1, the inner casing 32 is generally toroidal due to its C-shaped axial section. The header 38 portion of the inner casing is thusly disposed axially forward of both the first and second end flanges 34,36 thereof for receiving the inner shell 42 forward of the casing aft flange 34. And, the inner shell 42 is spaced radially outwardly from the inner casing 32 to define an annulus 86 therebetween through which the pressurized air 16 is channeled for flow through the inner wall of the combustor.

As shown in FIGS. 2 and 3, the shell aft flange 44 preferably includes a row of axial bypass holes 88 disposed in flow communication with the casing annulus 86 for channeling a portion of the air 16 axially therethrough.

As indicated above, the inner retainer 64 is conveniently provided by a suitable portion of the annular support for the HP nozzle. The retainer includes a radially inner portion which is suitably fastened by bolts to the casing aft flange 34, and includes a radially outer portion in which the stator nozzle is mounted.

The inner retainer 64 as illustrated in FIG. 2 also includes a row of generally axially disposed apertures 90 extending through the radially outer flange thereof, and circumferentially aligned with respective ones of the bypass holes 88. In this way, the pressurized air 16 may be metered through the bypass holes 88 for providing pressurization in the annular cavity defined between the inner band of the HP nozzle and its inner support. As shown in FIG. 2, the small radial flange of the inner retainer 64 through which the apertures 90 are provided is an otherwise conventional feature for supporting a leaf seal (not shown).

The dual rabbet mounting of the inner liner 54 and the inner shell 42 to the cooperating inner casing 32 enjoys simplicity of construction and the several benefits described above including concentricity of the combustion chamber with the HP nozzle while maintaining accurate circumferential alignment of the simply mounted inner liner and inner shell. As shown in FIG. 2, the shell aft flange 44 is radially supported on the first rabbet 40 and axially trapped between the inner retainer 34 on one side and the shoulder of the first rabbet on the other side. The manufacturing tolerances and clearances between these components may be relatively small for the direct trapping of the shell aft flange in the first rabbet without the need or desire for additional sealing members thereat.

Similarly, the liner aft flange 56 is radially supported around the second rabbet 50 and axially trapped between the outer retainer 66 on one side thereof and the shoulder of the second rabbet 50 on the opposite side thereof. Again, the manufacturing tolerances or clearances may be relatively small for directly trapping the liner aft flange 56 around the second rabbet without the need or desire for additional sealing members thereat.

This nested duplex rabbet mounting of the combustor inner wall to the inner casing is relatively simple in configuration and enjoys the additional benefit of simple assembly, and disassembly for maintenance and repair. More specifically, FIG. 3 illustrates schematically the assembly and corresponding disassembly of the inner combustor wall. The inner liner 54 itself is initially axially mounted around the inner shell 42 to seat the liner aft flange 56 in the second rabbet 50, while circumferentially aligning the several pins 80 and their mating sockets 82.

The outer retainer 66 may then be conveniently welded in position on the exposed ledge of the second rabbet 50 following seating of the liner aft flange 56 in axial abutment against the rabbet shoulder.

The inner shell 42, with the inner liner premounted thereon, is then axially mounted around the inner casing 32 to seat the shell aft flange 44 in the first rabbet 40, while circumferentially aligning the mating keys 76 and slots 78. The inner retainer 64 may then be axially mounted on the exposed shelf of the first rabbet 40 to axially trap the shell aft flange 44 in the first rabbet.

In order to repair the combustor, for example by replacing the inner liner 54 thereof, the assembly process may be reversed. The inner retainer 64 is axially removed from the inner casing 32 after the fasteners are disassembled. The inner shell 42 and inner liner 54 supported thereon may then be axially removed from the inner casing 32. The outer retainer 66 may then be removed from the second rabbet 50, by grinding of the tack welds for example, to then release the inner liner 54 from the second rabbet.

The inner liner may then be removed from the inner shell and replaced with a new inner liner, with the assembly process then being repeated to reassemble the combustor with a new outer retainer 66, and either the originally used or new inner retainer 64.

The double rabbet aft mounting of the annular combustor illustrated in FIG. 1 therefore enjoys various advantages in simplicity, assembly, disassembly, and maintenance repair. Concentricity between the combustion chamber and the HP nozzle and alignment of the fuel injectors, air swirlers, and dilution holes are ensured. And, pressurization air may be conveniently channeled through the bypass holes for pressurizing the inner cavity below the turbine nozzle.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

We claim:

1. A combustor comprising:

an annular outer casing;

an annular inner casing including first and second flanges at opposite ends with a header therebetween, said first flange having a first rabbet circumferentially thereround, and said second flange being fixedly supported from said outer casing;

said header including a row of fuel injectors mounted through apertures therein;

an annular inner shell including first and second flanges at opposite ends thereof with a dome therebetween, and a radially outer second rabbet around said first flange thereof, with said shell first flange being seated in said first rabbet;

said dome including a row of air swirlers mounted in apertures therein and receiving in circumferential alignment corresponding ones of said fuel injectors;

an annular inner combustion liner including first and second flanges at opposite ends, and said liner first flange being seated around said second rabbet;

an annular outer combustor wall mounted to said shell second flange; and an annular inner retainer fixedly joined to said casing first flange to axially trap said shell first flange around said first rabbet.

2. A combustor according to claim 1 wherein said inner casing is toroidal, with said header being disposed axially forward of both said first and second flanges thereof for receiving said inner shell forward of said casing first flange to define an annulus therebetween for channeling pressurized air therethrough.

3. A combustor according to claim 2 further comprising a row of bypass holes disposed through said shell first flange in flow communication with said annulus.

4. A combustor according to claim 3 wherein said inner retainer includes a radially outer flange having a row of apertures extending therethrough circumferentially aligned with respective ones of said bypass holes.

5. A combustor according to claim 4 further comprising a plurality of keys mounted in respective slots between said shell first flange and said first rabbet for maintaining circumferential alignment between said fuel injectors in said header and said air swirlers in said dome.

6. A combustor according to claim 5 wherein:

said inner liner includes a row of dilution holes for channeling dilution air therethrough; and further comprising a plurality of pins mounted in respective sockets between said liner first flange and said second rabbet for maintaining circumferential alignment between said dilution holes and said swirler apertures in said dome.

7. A combustor according to claim 6 wherein:

said keys are fixedly mounted in said shell first flange, and said slots are disposed in said first rabbet in radial alignment therewith; and said pins are fixedly joined to said inner shell radially outwardly of said second rabbet, and said sockets are disposed in said liner first flange in axial alignment therewith.

8. A combustor according to claim 7 further comprising an annular outer retainer fixedly joined to said second rabbet to axially trap said liner first flange around said second rabbet.

9. A method of assembling said combustor according to claim 8 comprising:

axially mounting said inner liner around inner shell to seat said liner first flange in said second rabbet, while circumferentially aligning said pins and sockets;

axially mounting said inner shell around said inner casing to seat said shell first flange in said first rabbet, while circumferentially aligning said keys and slots;

fixedly joining said outer retainer to said second rabbet to axially trap said liner first flange around said second rabbet; and axially mounting said inner retainer in said first rabbet to axially trap said shell first flange in said first rabbet.

10. A method of repairing said combustor according to claim 8 comprising:

removing said inner retainer from said inner casing;

removing said inner shell and liner from said inner casing;

removing said outer retainer from said second rabbet to release said inner liner;

removing and replacing said inner liner from said inner shell; and reassembling said replaced inner liner with said inner shell on said inner casing.

11. A combustor comprising:

an annular inner casing including first and second flanges at opposite ends, and a radially outer first rabbet around said first flange thereof;

an annular inner shell including first and second flanges at opposite ends, and a radially outer second rabbet around said first flange thereof, with said shell first flange being seated in said first rabbet;

an annular inner combustion liner including first and second flanges at opposite ends, and said liner first flange being seated around said second rabbet;

an annular outer combustor wall mounted to said shell second flange; and an annular inner retainer fixedly joined to said casing first flange to axially trap said shell first flange around said first rabbet.

12. A combustor according to claim 11 wherein:

said inner casing further includes an annular header adjoining said casing second flange, and a row of apertures therethrough for mounting corresponding fuel injectors therein;

said inner shell further includes an annular dome adjoining said shell second flange, and a row of apertures therethrough for mounting corresponding air swirlers therein in circumferential alignment with respective ones of said casing apertures; and further comprising a plurality of keys mounted in respective slots between said shell first flange and said first rabbet for maintaining circumferential alignment between said apertures in said header and dome.

13. A combustor according to claim 12 wherein:

said inner liner includes a row of dilution holes for channeling dilution air therethrough; and further comprising a plurality of pins mounted in respective sockets between said liner first flange and said second rabbet for maintaining circumferential alignment between said dilution holes and said swirler apertures in said dome.

14. A combustor according to claim 13 further comprising a row of bypass holes disposed through said shell first flange in flow communication with an annulus defined between said inner casing and said shell.

15. A combustor according to claim 14 wherein said inner retainer includes a radially outer flange having a row of apertures extending therethrough circumferentially aligned with respective ones of said bypass holes.

16. A combustor according to claim 13 further comprising an annular outer retainer fixedly joined to said second rabbet to axially trap said liner first flange around said second rabbet.

17. A method of assembling said combustor according to claim 13 comprising:

axially mounting said inner liner around inner shell to seat said liner first flange in said second rabbet, while circumferentially aligning said pins and sockets; and axially mounting said inner shell around said inner casing to seat said shell first flange in said first rabbet, while circumferentially aligning said keys and slots.

18. A method according to claim 17 further comprising axially mounting said inner retainer in said first rabbet to axially trap said shell first flange in said first rabbet.

19. A combustor according to claim 13 wherein said keys are fixedly mounted in said shell first flange, and said slots are disposed in said first rabbet in radial alignment therewith.

20. A combustor according to claim 13 wherein said pins are fixedly joined to said inner shell radially outwardly of said second rabbet, and said sockets are disposed in said liner first flange in axial alignment therewith.

* * * * *